US011512835B1

(12) United States Patent
Dozier

(10) Patent No.: US 11,512,835 B1
(45) Date of Patent: Nov. 29, 2022

(54) ILLUMINATED KINETIC ARTWORK DISPLAY APPARATUS

(71) Applicant: Matthew Dozier, San Francisco, CA (US)

(72) Inventor: Matthew Dozier, San Francisco, CA (US)

( * ) Notice: Subject to any disclaimer, the term of this patent is extended or adjusted under 35 U.S.C. 154(b) by 0 days.

(21) Appl. No.: 17/648,129

(22) Filed: Jan. 15, 2022

(51) Int. Cl.

| | |
|---|---|
| ***F21V 9/12*** | (2006.01) |
| ***F21K 9/62*** | (2016.01) |
| ***A47F 3/00*** | (2006.01) |
| ***F21V 33/00*** | (2006.01) |
| ***F21Y 115/30*** | (2016.01) |

(52) U.S. Cl.
CPC ..... *F21V 9/12* (2013.01); *A47F 3/001* (2013.01); *F21K 9/62* (2016.08); *F21V 33/0012* (2013.01); *F21Y 2115/30* (2016.08)

(58) Field of Classification Search
CPC ..... F21V 9/12; F21V 33/0012; F21K 9/62; A47F 3/001
See application file for complete search history.

(56) References Cited

U.S. PATENT DOCUMENTS 4,461,106 A * 7/1984 Lawson ..... G09F 11/025 40/430
5,109,989 A * 5/1992 Kremmin ..... A47F 5/025 211/163
6,427,368 B1 * 8/2002 Yang ..... G09F 19/08 84/95.2
6,485,350 B1 * 11/2002 Giglio ..... A63H 33/42 446/353

* cited by examiner

*Primary Examiner* — Thomas M Sember
(74) *Attorney, Agent, or Firm* — Ivan E. Rozek; Savantek Patent Services

(57) ABSTRACT

A novel illuminated kinetic artwork display apparatus implemented in a wall mountable cuboid frame, the frame comprising an enclosed display space covered by a slidably attached transparent plate, a plurality of removable and replaceable and rotatable acrylic members illuminated by a plurality of laser light beams causing the reflected light to produce a novel animated light display within the enclosed display space. The kinetic artwork display is controlled by the user a plurality of switches via a microcontroller. The self-contained apparatus also comprises a power supply and all electrical and mechanical components. An embodiment enabling the user to introduce dry ice to create a smoke-like atmosphere within the enclosed display space is presented.

6 Claims, 7 Drawing Sheets

ILLUMINATED KINETIC ARTWORK DISPLAY APPARATUS

CROSS REFERENCE TO RELATED APPLICATIONS

Not Applicable.

STATEMENT REGARDING FEDERALLY SPONSORED RESEARCH OR DEVELOPMENT

Not Applicable.

DESCRIPTION OF ATTACHED APPENDIX

Not Applicable.

BACKGROUND OF THE INVENTION

This invention relates generally to the field of wall mounted lit displays and more specifically to a wall mounted laser light display assisted by reflective kinetic and non-kinetic elements. Other decorative laser displays have been designed, including:

U.S. Pat. No. 3,749,903 shows a decorative reflection device that transmits light creating a reflective pattern using a rotating disk and or dome.

U.S. Pat. No. 4,250,537 shows a home entertainment system that uses a rotating reflective ball to reflect light out into a room.

U.S. Pat. No. 4,829,537 discloses a laser shot into a sphere which makes internal reflected light within the sphere.

U.S. Pat. No. 6,210,022 shows an ornamental light display where light beams shine upward and strike crystals so that the crystals radiate out light patterns.

Patent application 2003/0193654 discloses a laser display where the laser intersects a rotating crystal or optical element to project a variable light display.

Patent application 2007/009681 shows a lighting device that includes LEDs or laser diodes to emit light onto a dome that has raised portions for refracting light. A driving mechanism rotates a lens that is in front of the light source.

Patent application 2010/0053476 discloses a method for creating speckling from a laser light source using rotating mirrors and projection optics causing a speckled light pattern to appear and disappear on a screen.

Patent application 2011/0007496 shows a laser project light that projects laser images onto a surface.

The above patents and patent applications show that the idea of projecting a laser beam onto a rotating reflective surface is not novel. However, none of the above patents show a unique design of a plurality of transparent acrylic shapes that can be held magnetically and rotated within a hollow display space enclosed in a frame and where multiple rotating shapes and or multiple laser beams can create a novel lighting pattern within the hollow display space enclosed in the frame.

BRIEF SUMMARY OF THE INSTANT INVENTION

The primary object of the invention is to provide a laser light kinetic art display within a wall mountable, or flat laying apparatus where removable and replaceable transparent acrylic members are each magnetically attached to shafts of gearmotors and rotate within a 3-dimensional hollow display space enclosed in a decorative frame; and where inwardly pointing laser diodes are mounted around the perimeter of the frame and strike the acrylic members causing light emitted from the laser diodes to be reflected on the mirror-like surfaces of the inner walls of the frame producing a moving lighted decorative display within the frame.

Additional object of the invention is to provide a frame containing a laser light display where a plurality of removable and replaceable and rotatable acrylic members that when struck by a plurality of laser lights will reflect the lights to produce a novel animated light display within the frame.

Another object of the invention is to provide a light display within a frame where the user can add dry ice or other smoke inducing mechanisms to the frame causing a smoky appearance within the boundaries of the frame further accentuating the animated light display.

Another object of the invention is to provide a laser light display that allows the user to control the display by adjusting the speed and duration of rotation the acrylic members.

Another object of the invention is to provide a wall mounted laser light display that allows the user to remove and replace the acrylic members via magnetic attachment.

Other objects and advantages of the present invention will become apparent from the following descriptions, taken in connection with the accompanying drawings, wherein, by way of illustration and example, an embodiment of the present invention is disclosed.

In accordance with a preferred embodiment of the invention, there is disclosed a laser light display apparatus comprised of wall mountable frame, a transparent front panel, a backplate, a plurality of laser light source, typically laser diodes, a plurality of acrylic members, a plurality of gearmotors, a plurality of magnets, a power supply, a microcontroller, and a plurality of switches.

BRIEF DESCRIPTION OF THE DRAWINGS

The drawings constitute a part of this specification and include exemplary embodiments to the instant invention, which may be embodied in various forms. It is to be understood that in some instances various aspects of the instant embodiments may be shown exaggerated or enlarged to facilitate an understanding of the instant invention.

DETAILED DESCRIPTION OF THE PREFERRED EMBODIMENTS

Detailed descriptions of the preferred embodiment are provided herein. It is to be understood, however, that the present invention may be embodied in various forms. Therefore, specific details disclosed herein are not to be interpreted as limiting, but rather as a basis for the claims and as a representative basis for teaching one skilled in the art to employ the present invention in virtually any appropriately detailed system, structure, or manner.

Figure 1:
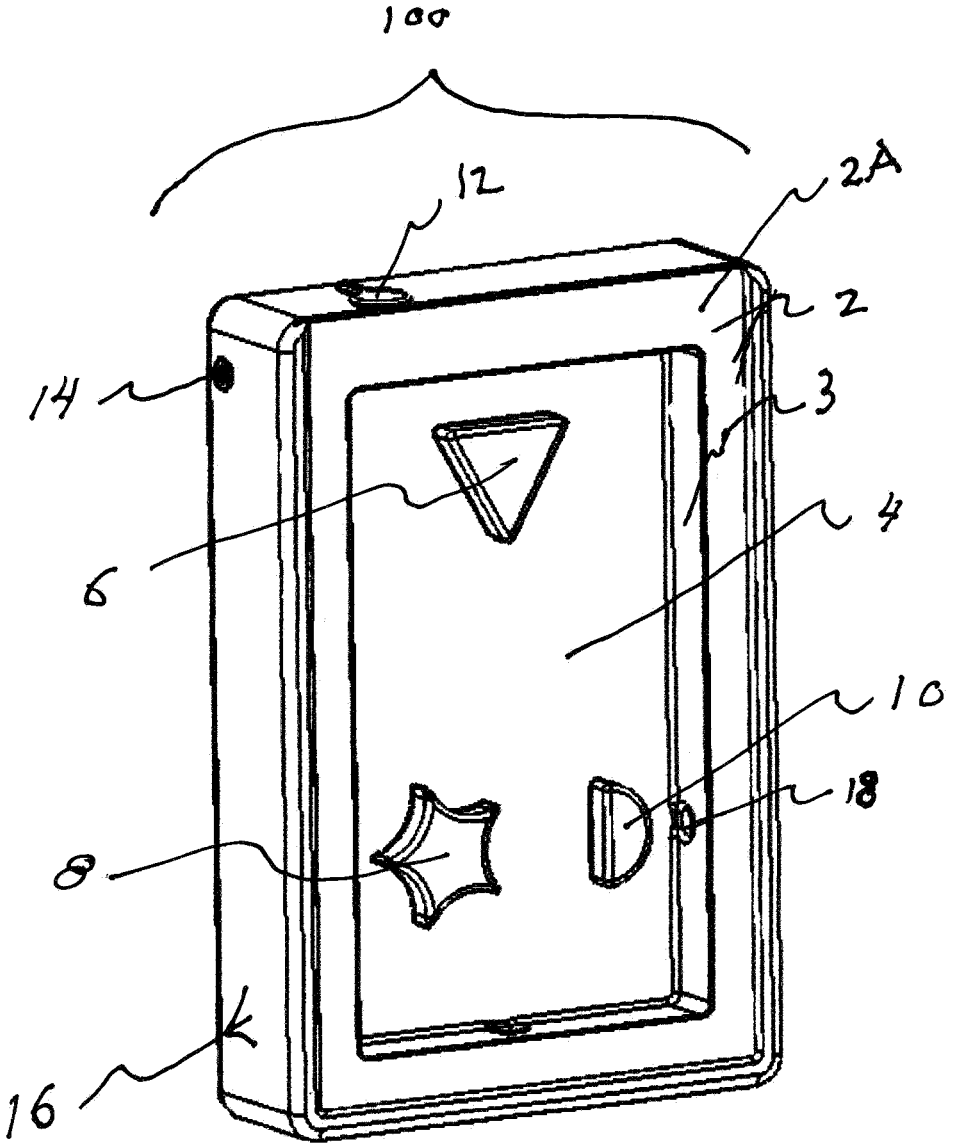
FIG. 1 is a front perspective view of the embodiment.

Referring now to FIG. 1 we see a perspective view of embodiment 100. A cuboid frame 2 in the instant embodiment, constructed of rectangular tube frame members that are hollow inside. The inwardly facing surface 3 of the frame 2 is made of optically mirror like reflective material. A back plate 4 is located at the back portion of the frame 2. In the preferred embodiment, the back plate 4 has a matte surface. A plurality of transparent acrylic members 6, 8, 10 are supported on the back plate via magnets as will be described below. A plurality of apertures 18 allow light from light sources, laser diodes 30, 32, 34 in the instant embodiment, shown in FIG. 5 to direct a light towards transparent acrylic members 6, 8, 10 causing the light to illuminate the members 6, 8, 10 and cause the light to be dispersed and reflected by inwardly facing frame surface 3 creating decorative illuminated artwork within the confines of the frame member 2. Only one aperture 18 is visible, the location of the others is obvious from the locations of the laser diodes shown in FIG. 5. Because the acrylic members 6, 8, 10 are capable of rotating via gearmotors mounted on the underside of back plate 4, shown in FIG. 7, the dispersed light is animated in novel ways to produce a kinetic illuminated artwork. Switch 14 allows a user to provide electrical power to all internal elements needing electricity.

Figure 2:
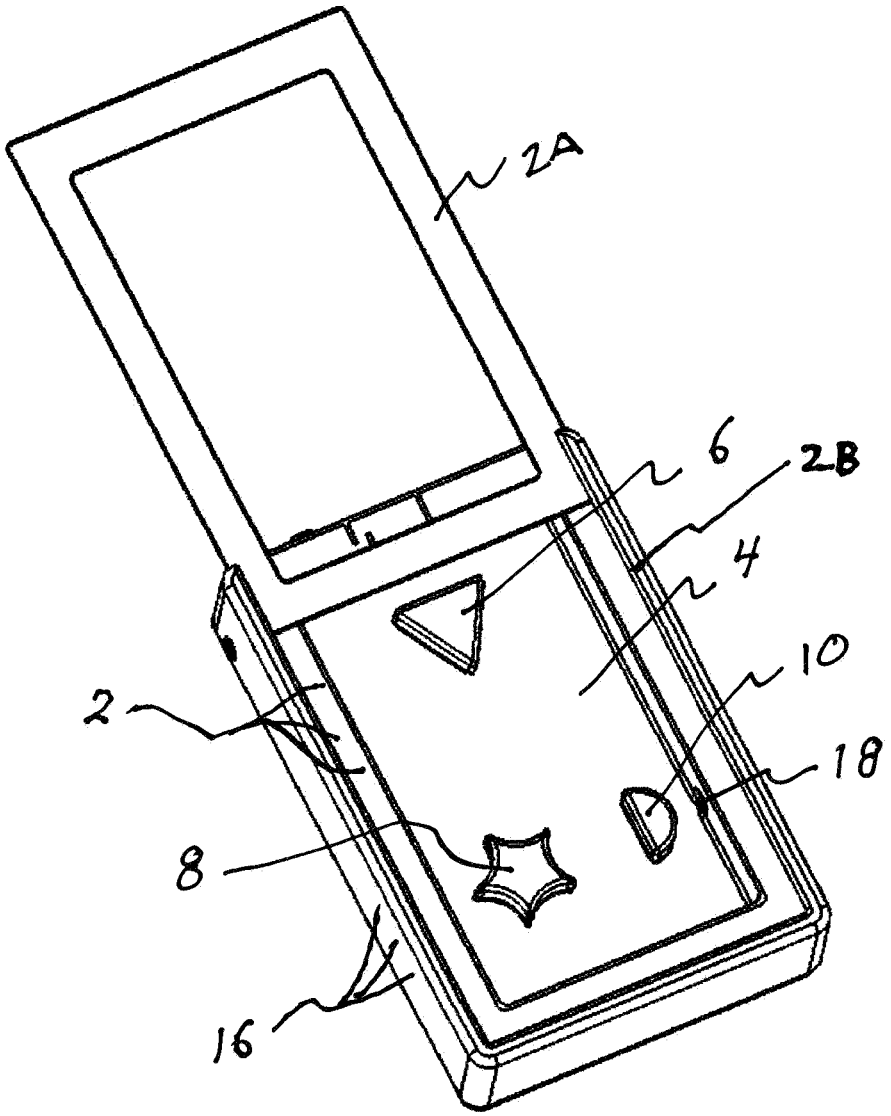
FIG. 2 is a perspective view of the embodiment with the transparent front cover panel partially removed.

FIG. 2 is a perspective view of the embodiment with the front cover panel 2A of the frame 2 slid out via track 2B to enable a user to remove and replace acrylic members 6, 8, 10. In this way, the user can select other acrylic shapes to create other interesting light patterns.

Figure 3:
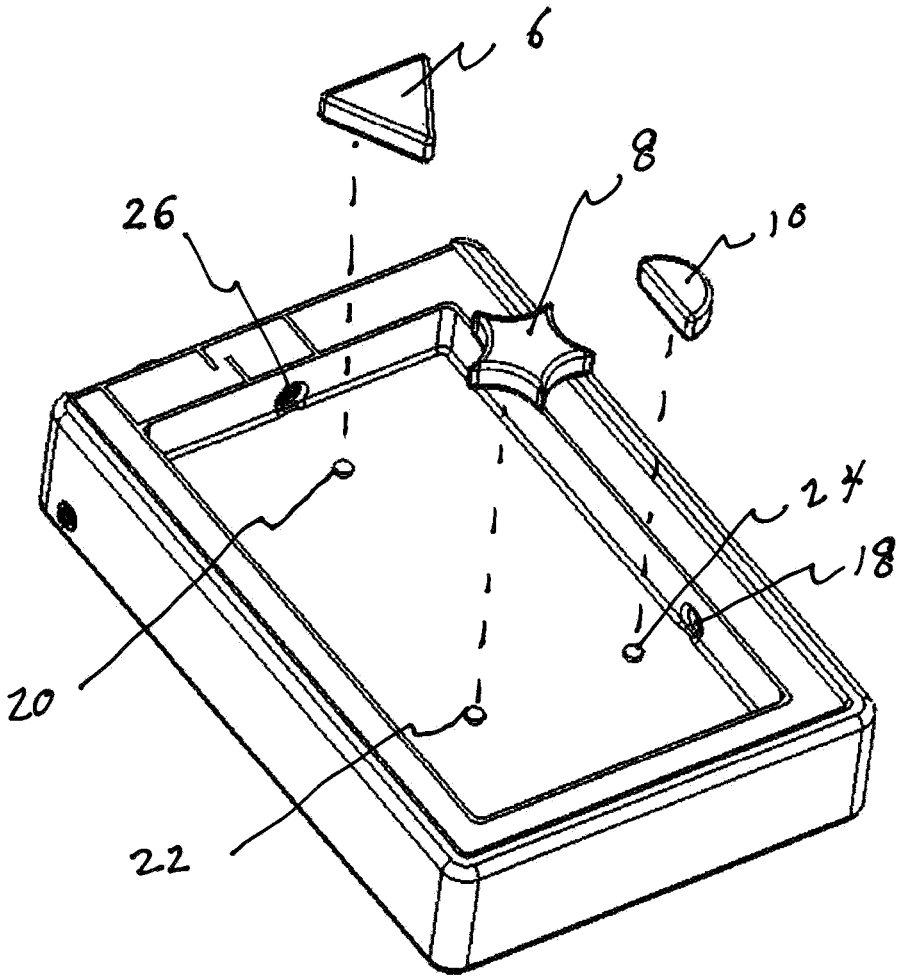
FIG. 3 is a perspective exploded view of the embodiment showing the acrylic members removed.
Figure 7:
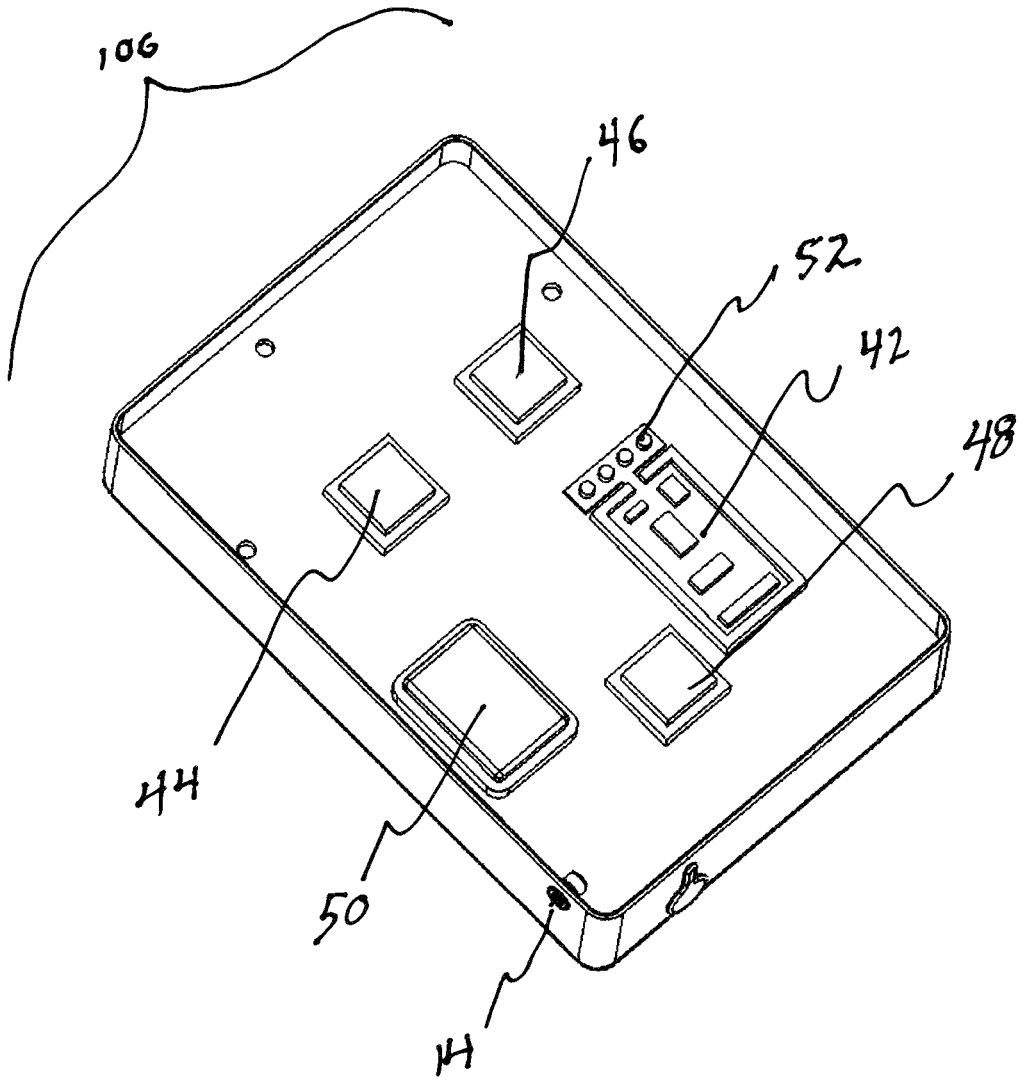
FIG. 7 is a perspective view of the back of the embodiment.

FIG. 3 is an exploded perspective view showing the acrylic members 6, 8, 10 removed from magnetic engagement members 20, 22, 24 which are attached to the ends of gearmotor shafts of gearmotors 44, 46, 48 shown in FIG. 7. Matching magnets located on the under surfaces of acrylic members 20, 22, 24, not shown, removably attach the acrylic members 20, 22, 24 to the shafts of gearmotors 44, 46, 48. The user has the option to install other shaped acrylic members, not shown, to produce other novel light displays.

Figure 4:
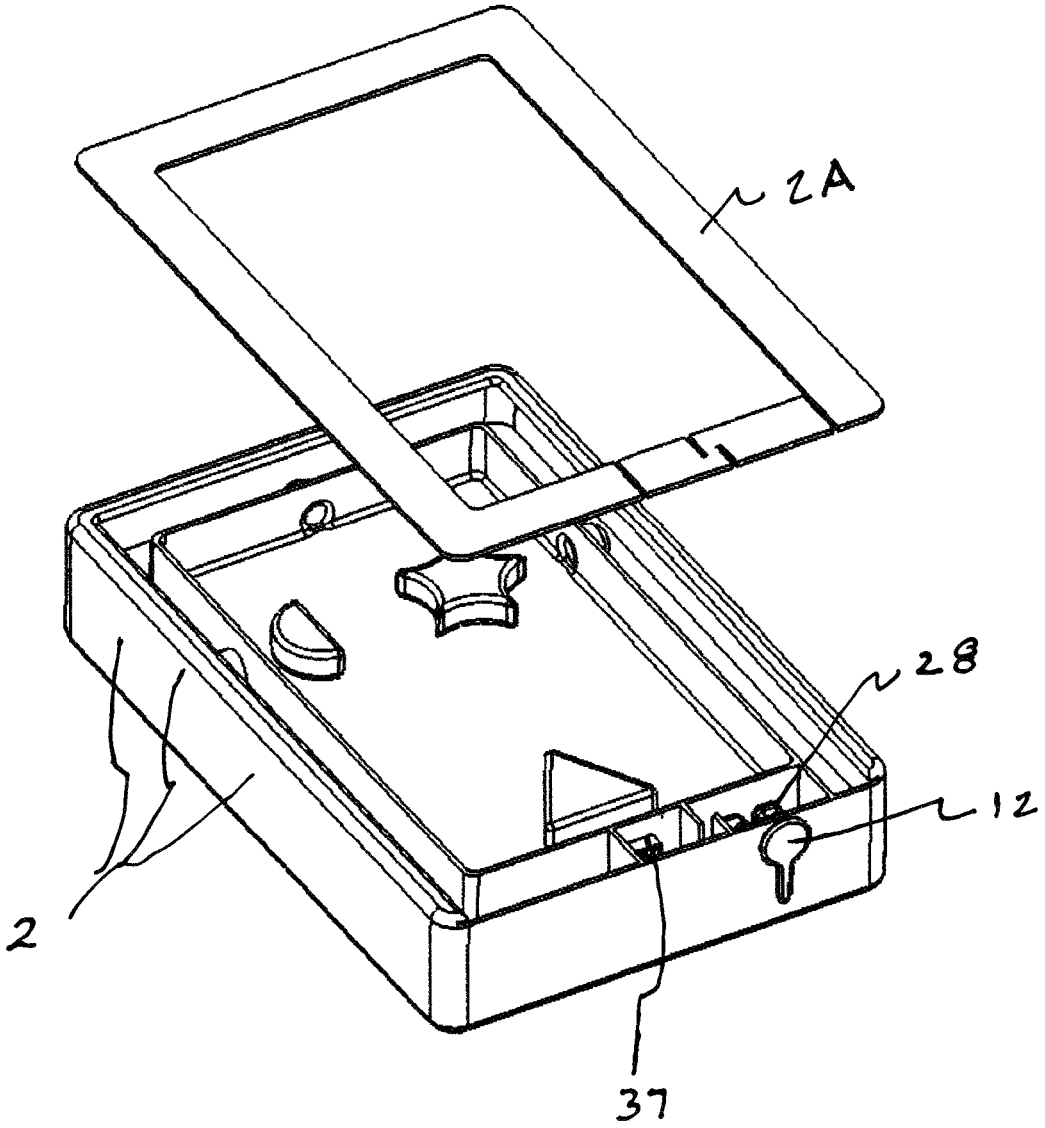
FIG. 4 is a perspective exploded view of the embodiment.

FIG. 4 is an exploded perspective view showing the front frame cover panel 2A removed from hollow frame 2. Dry ice 28 has been inserted into the frame 2 via opening of closure member 12. An axial fan 37 blows the smoke from the dry ice 28 into the area within frame 2. The smoke-like effect causes the projected and reflected laser light to be more visible to a person looking at the embodiment 100.

Figure 5:
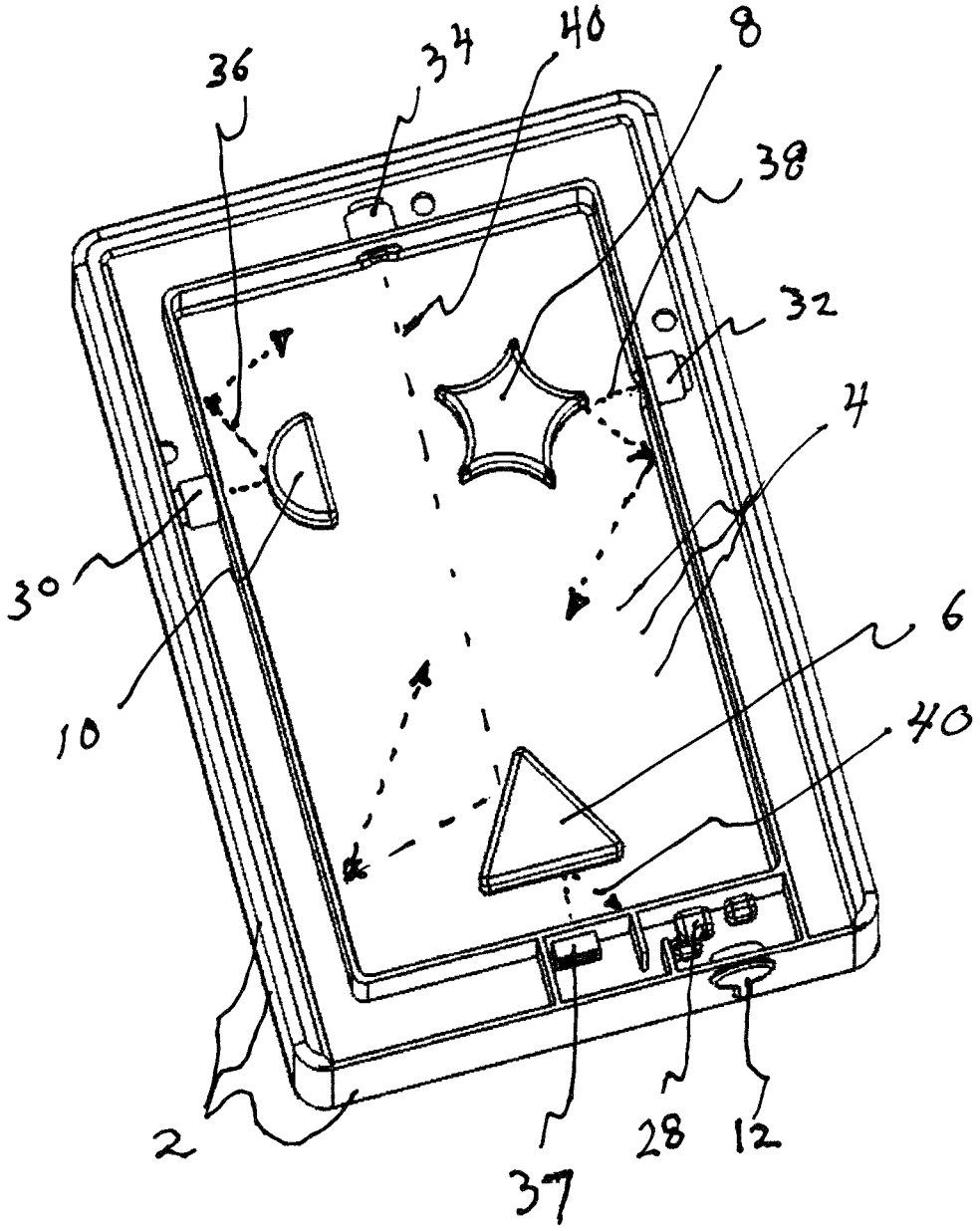
FIG. 5 is a top view of the embodiment with the front panel removed.

FIG. 5 is a top view of the embodiment with the front frame cover panel 2A removed. This view clearly shows the placement of light sources, laser diodes 30, 32, 34 in the instant embodiment. Light paths are shown by dotted lines 36, 38, 40. The light paths change as the acrylic members 6, 8, 10 rotate. Fan 37 blows smoke-like material through an aperture, not shown into the central portion internal to frame 2. The reflective nature of inwardly facing frame surface 3 further increases the complexity of the light display generated by the embodiment 100.

Figure 6:
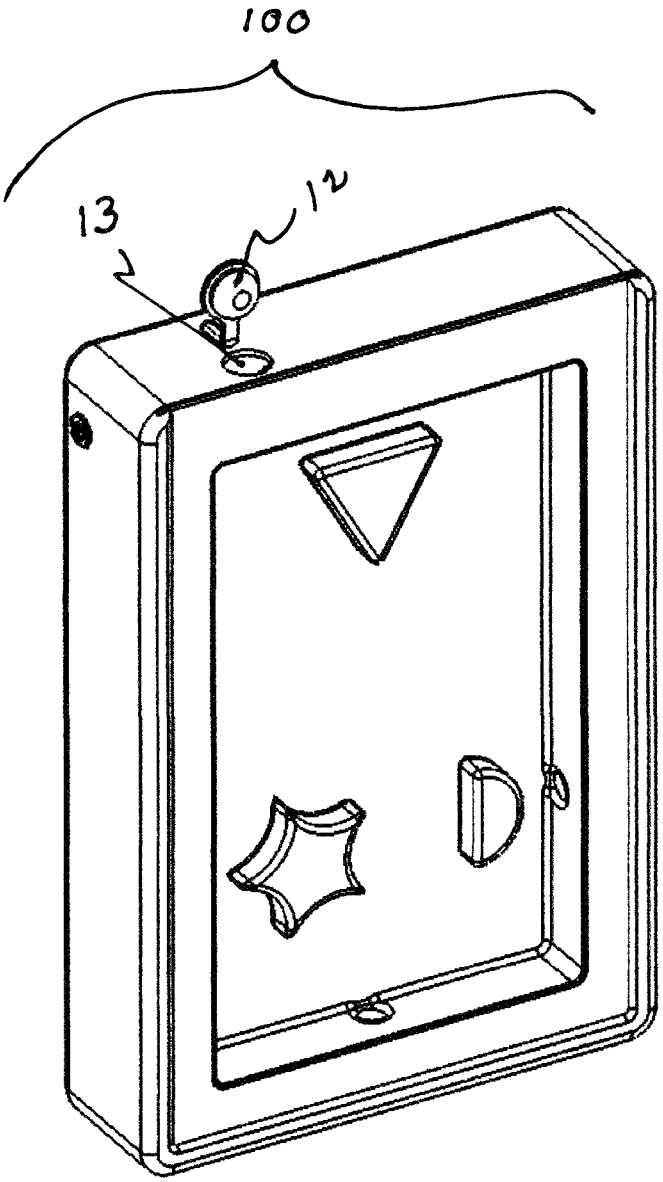
FIG. 6 is a perspective view of the embodiment showing the dry ice cap in the open position.

FIG. 6 is a perspective view showing dry ice insert port 13 uncovered from closure member 12. Although dry ice is one method of producing smoke-like material, other methods may be used including ultrasonic mist caused by the dispersion of water, and the heated coil and oil method found in E cigarettes.

FIG. 7 is a perspective view of the underside of the embodiment 100. Gearmotors 44, 46, 48 are shown from their back sides. Rechargeable battery 50 powers the display, however the display can also be powered by a home or office wall plug where an AC to DC wall-pack transformer can provide the proper DC voltage to the embodiment 100. Switch 14 turns the light display and all powered devices on or off. Microcontroller 42 controls the speed of gearmotors 44, 46, 48 as well as the duration of illumination and the turning on or off the fan for the dry ice function. Switches 52 allow the user to program the microcontroller 42 to cause the gearmotors and laser light emitting diodes to perform in various ways. The microcontroller can also receive audio signals so that musical tones can be translated into a pulsating laser light show in combination with the rotation of the acrylic members.

Although the embodiment is mainly intended to hang on a wall, it can be used on any flat surface, such as a desk or table for example.

While the invention has been described in connection with a preferred embodiment, it is not intended to limit the scope of the invention to the particular form set forth, but on the contrary, it is intended to cover such alternatives, modifications, and equivalents as may be included within the spirit and scope of the invention as defined by the appended claims.

Defining terms "top", "bottom", "left", and "right" is for reference only and should not be construed to mean that the apparatus cannot be used in alternate orientations.

In the claims, the word "comprising" does not exclude the presence of other elements or steps then those listed in a claim. Furthermore, the terms "a" or "an," as used herein, are defined as "one, or more than one." Also, the use of introductory phrases such as "at least one" and "one or more" in the claims should not be construed to imply that the introduction of another claim element by the indefinite articles "a" or "an" limits any particular claim containing such introduced claim element to inventions containing only one such element, even when the same claim includes the introductory phrases "one or more" or "at least one" and indefinite articles such as "a" or "an." The same holds true for the use of definite articles. Unless stated otherwise, terms such as "first" and "second" are arbitrarily used to distinguish between the elements such terms describe. Thus, these terms are not necessarily intended to indicate temporal or other prioritization of such elements. The mere fact that certain measures are recited in mutually different claims does not indicate that a combination of these measures cannot be used to advantage.

What is claimed is:

1. An apparatus in a self-contained wall mountable frame for creating and displaying an illuminated kinetic artwork comprised of a plurality of moving light beams, the apparatus comprising:

a wall mountable frame enclosing an essentially hollow space, the enclosed hollow space being divided by a matte plate into a front hollow space portion for displaying the illuminated kinetic artwork and a back hollow space portion, the front hollow space further covered by a transparent plate;

a plurality of visible light sources;

a plurality of movable transparent shapes;

a plurality of gearmotors;

a plurality of light sources;

a programmable control system, main components of the control system comprised of a microcontroller, a plurality of selector switches, a power supply, and a plurality of electronic and mechanical devices connecting the control system to the plurality of the light sources and the plurality of gearmotors disposed in the back hollow space portion; and the frame comprised of a plurality of hollow tube members wherein a surface of the hollow tube member facing into the enclosed hollow space being divided by the matte plate into a front frame portion and a back frame portion, wherein furthermore the front frame portion comprises a mirror like finished surface wherein furthermore the front frame portion comprises a plurality of light entry apertures wherein furthermore disposed within the hollow of the front frame portion is the plurality of the light sources, each light source of the plurality of the light sources disposed next to the one of the plurality of light entry apertures projecting a light beam into the enclosed front hollow space through the light entry aperture.

2. The apparatus of claim 1 wherein the plurality of gearmotors is disposed in the enclosed back hollow space, wherein each gearmotor of the plurality of gearmotors comprises a shaft rotatably protruding into the enclosed front hollow space, each shaft protrusion into the enclosed front hollow space comprising a magnetic tip;

each of the plurality of movable transparent shapes comprising a top portion and a bottom portion, wherein a magnet being disposed in the bottom portion of each of the plurality of movable transparent shapes, each of the plurality of movable transparent shapes removably magnetically attached to the gearmotor shaft magnetic tip;

wherein each of the plurality of movable transparent shape being intercepting at least one of the plurality of light beams, wherein each intercepted light beam is partially movably reflected by the intercepting movable transparent shape and partially movably distortedly passed through the movable transparent shape; and wherein each light beam is furthermore reflected from the mirror like finished surface of the top portion of the frame enclosing the front hollow space.

3. The apparatus of claim 2 wherein the each of the light sources is a laser diode.

4. The apparatus of claim 3 further comprising a smoke-like mist dispersing subsystem disposed within the hollow frame creating an additional kinetic artwork effect, wherein the smoke-like mist dispersing subsystem being selected from the group comprising:

a. a fan and a dry ice container being disposed within the hollow of the frame, wherein a smoke-like effect is achieved within the hollow display space by the fan blowing dry ice from the container via a closable aperture, b. a water container and an ultrasonic misting device being disposed within the hollow of the frame, wherein the smoke like effect is achieved by ultrasonically misting the water in the water container, and c. an oil container and a heated coil being disposed within the hollow of the frame, wherein the smoke like effect is achieved by heating oil with the heated coil.

5. The apparatus of claim 4 wherein the self-contained wall mountable frame encloses an essentially cuboid hollow space, wherein the frame comprises four hollow tube members, each member having a rectangular cross section.

6. A method wherein a user creates a kinetic artwork comprising movable light beams projected into a hollow display space enclosed in a wall mountable frame, the light beam sources projected from the frame enclosing the hollow display space, the front space further comprising transparent movable shapes deflecting the projected light beams, the light beams furthermore reflected from a mirror like finish on surfaces of the enclosing frame facing the display hollow space, the method comprising steps of:

operating a plurality of programming switches to select:

a desired program sequence of projecting light beams into the front hollow space portion;

a selection and rotational speed of the gearmotors;

placing or removing the transparent movable shape members; and activating smoke-like mist mechanism to discharge the smoke like vapor into the front hollow space portion; and whereby a movement of the transparent movable shapes intercepting the projected light beams creates the kinetic light artwork observable in the display hollow space.

* * * * *